United States Patent [19]

Hlinsky

[11] 4,143,600

[45] Mar. 13, 1979

[54] CHAIN ATTACHMENT STRUCTURE

[75] Inventor: Emil J. Hlinsky, Oak Brook, Ill.

[73] Assignee: MacLean-Fogg Company, Mundelein, Ill.

[21] Appl. No.: 760,869

[22] Filed: Jan. 21, 1977

[51] Int. Cl.[2] ..... B61D 45/00

[52] U.S. Cl. ..... 105/477; 24/68 CT; 242/125.1

[58] Field of Search ..... 254/164, 165, 161, 162, 254/163, DIG. 14; 105/477, 292, 295, 300 L-303, 306; 24/71.2, 68 CT, 68 TT, 69 TT, 69 T; 242/125.1; 248/499, 231; 403/315

[56] References Cited

U.S. PATENT DOCUMENTS

| | | | |
|---|---|---|---|
| 1,002,292 | 9/1911 | McCarthy | 105/388 |
| 1,009,617 | 11/1911 | Zimmerman | 105/300 |
| 3,414,226 | 12/1968 | Patnaude | 248/499 |
| 3,836,123 | 6/1971 | Bausenbach | 254/DIG. 14 |

FOREIGN PATENT DOCUMENTS

| | | | |
|---|---|---|---|
| 83297 | 4/1935 | Sweden | 24/68 TT |
| 993608 | 6/1965 | United Kingdom | 242/125.1 |

*Primary Examiner*—Albert J. Makay
*Assistant Examiner*—D. W. Underwood
*Attorney, Agent, or Firm*—Mason, Kolehmainen, Rathburn & Wyss

[57] ABSTRACT

A chain attachment structure interconnects the end of a chain to the takeup drum of a winch or hoist so that the chain load is applied directly to an integral part of the drum even if the chain is fully unwound. A recess extends inward from the periphery of the drum and includes a pair of spaced walls. A lug integral with one wall extends toward the opposite wall. The space between the lug and the opposite wall defines a path for inserting a chain link into the recess and over the lug. A keeper inserted into the path prevents removal of the link from the lug.

8 Claims, 6 Drawing Figures

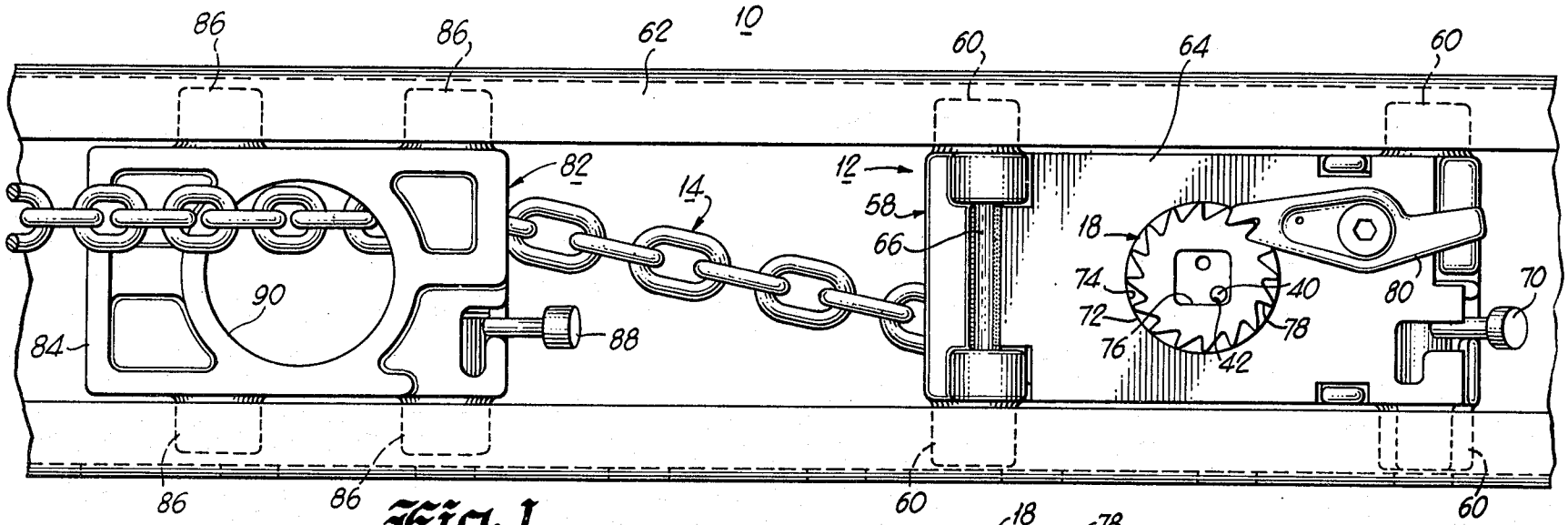
Fig. 1
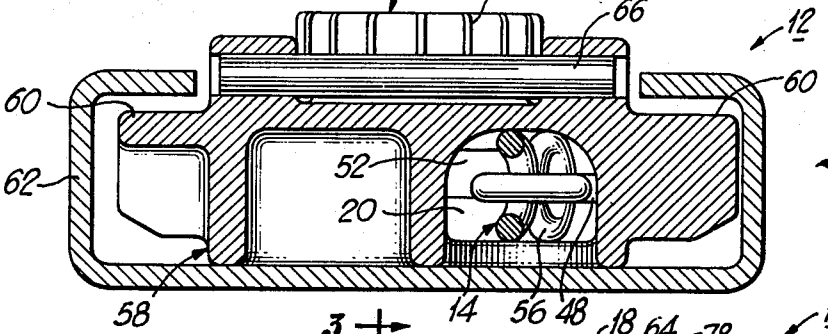
Fig. 3
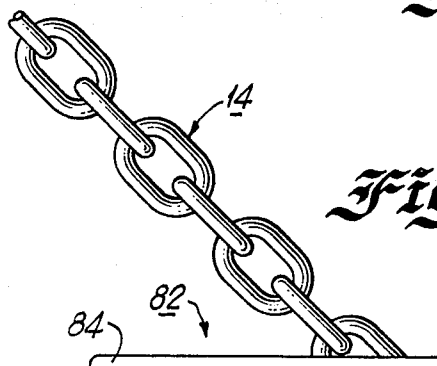
Fig. 2
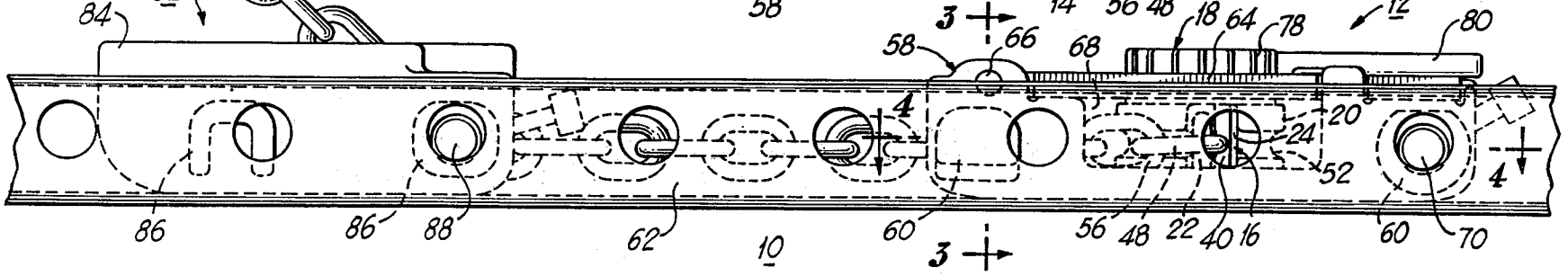

CHAIN ATTACHMENT STRUCTURE

The present invention relates to a chain attachment structure for releasably connecting the end of a load bearing chain to a chain takeup drum associated with a winch or hoist or the like.

Due to its strength and flexibility, chain is widely used with hoists, winches, and the like for many applications. Examples are cargo securement winches and load hoisting machines. Typically the chain is attached to a takeup drum, and the drum is rotated to wind the chain around the drum periphery in order to tighten the chain and/or lift a load. Because the chain carries large tensile loads, the connection between the chain and the drum must be secure. This presents little problem when the chain is permanently attached to the drum, as by welding, or when the chain is not unwound from the drum and the friction of multiple wraps of chain on the drum can be relied upon.

In some instances, multiple wraps and permanent attachment are not practical. One illustration of such an instance is a tiedown winch for securing cargo such as automotive vehicles to a railroad car or other transporting vehicle. In this environment, the chain should be releasably connected to the winch drum so that chains having different lengths or other characteristics can be used to secure different types of vehicles or loads. Multiple wraps of chain are undesirable because they increase the size of the winch and result in obstruction of the deck of the transporting vehicle. Multiple wraps also render detachment of the chain from the drum unnecessarily difficult.

In the past, when releasable attachment of a chain to a takeup drum has been required, the accepted expedient has been to insert a chain link into a recess in the drum, and to insert a keeper pin along a transverse path intersecting the link. This arrangement is objectionable in some situations because chain loads on the link are transferred to the keeper pin and from the keeper pin to the drum, rather than directly to the drum. When the chain is fully unwound, such loads can be very large, and can break or dislodge the pin, or can deform the pin to such an extent that it is difficult to withdraw the pin and disconnect the chain. One example of this prior art approach may be found in U.S. Pat. No. 3,158,108 — Sharp.

Bolting the chain link to the drum as disclosed, for example, in U.S. Pat. No. 3,140,850 — Packard, can produce a secure attachment. However, this is not a satisfactory solution to the problem because removing the bolt in order to release the chain requires substantial time and also requires the use of a wrench.

Among the important objects of the present invention are to provide a chain attachment structure permitting convenient detachment and attachment of a chain to a tiedown drum; to provide a structure wherein attachment and detachment can be accomplished quickly and without tools; to provide a structure wherein chain loads are transferred directly to the takeup drum, even when the chain is fully unwound; and to provide a chain attachment structure overcoming the disadvantages of those used in the past.

In brief, in accordance with the above and other objects of the present invention, there is provided a chain attachment structure for attaching a link of a load bearing chain to a takeup drum. The drum includes a periphery around which the chain is wound, and a recess extends inwardly from the periphery. A lug integral with the drum extends from one wall of the recess toward the opposite wall. The space between the end of the lug and the opposite wall permits the chain link to be inserted along a path into the recess and over the lug. A keeper pin is inserted into an opening intersecting the recess and blocks the path so that the inserted link cannot be removed from the lug. Chain loads are applied to the lug and not to the keeper pin.

The lug is positioned adjacent the mouth of the recess at the periphery of the drum so that when the inner end of the attached link is against the innermost end of the lug, the outer end of the link is positioned above the drum periphery a distance to accommodate the second link of the chain. The attached link lies in a plane parallel to the axis of rotation of the drum and the second link is retained in a plane normal to the axis. The periphery of the drum is provided with a groove sized to receive the second and alternate chain links thereby to guide the chain onto the drum.

The invention together with the above and other objects thereof will be best understood from consideration of the following detailed description of the embodiment of the invention illustrated in the drawings, wherein:

FIG. 1 is a top plan view of a load securement system including a tiedown winch incorporating a chain attachment structure constructed in accordance with the present invention;

FIG. 2 is a side elevational view of the system shown in FIG. 1;

FIG. 3 is a sectional view taken along the line 3—3 of FIG. 2;

Figure 4:
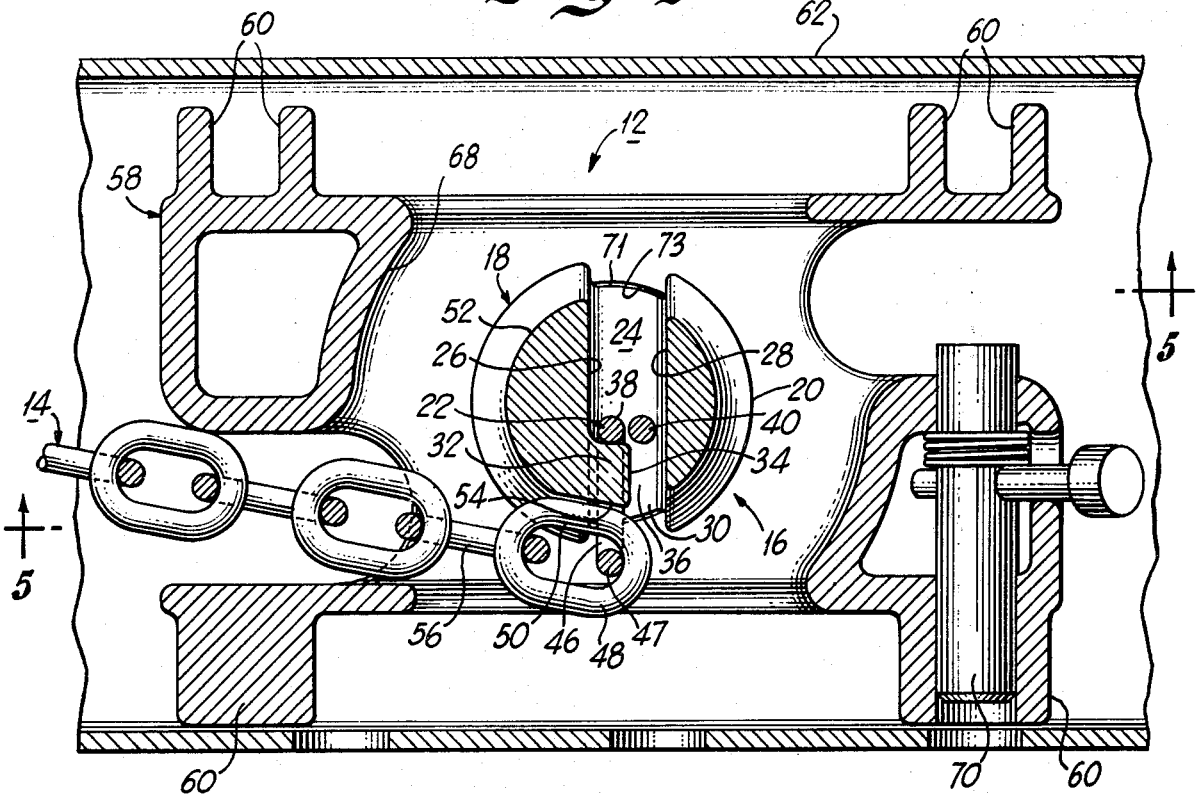
FIG. 4 is a sectional view taken along the line 4—4 of FIG. 2.
Figure 5:
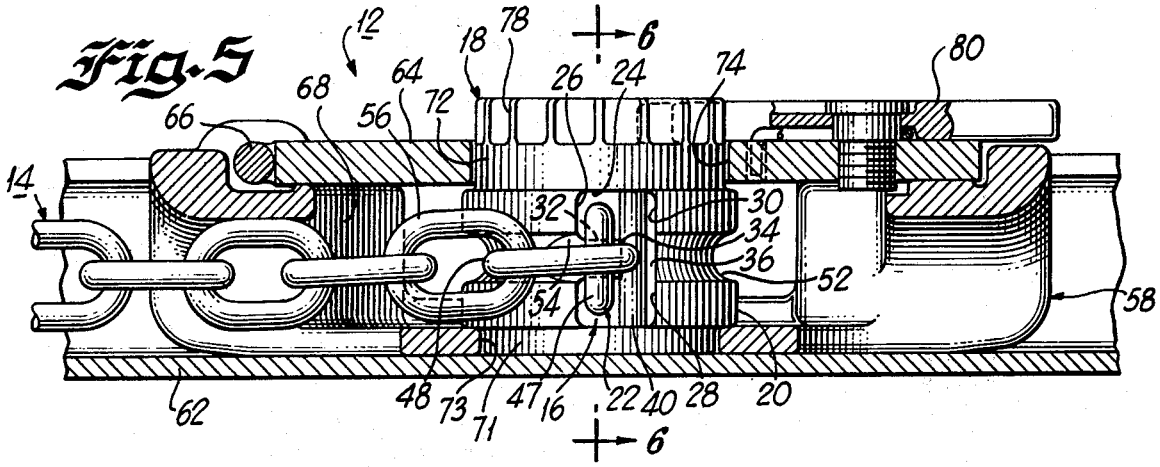
FIG. 5 is a sectional view taken substantially along the line 5—5 of FIG. 4.
Figure 6:
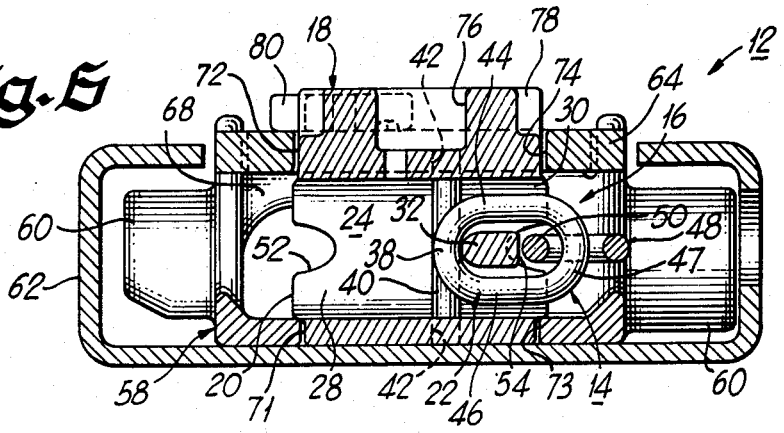
FIG. 6 is a sectional view taken along the line 6—6 of FIG. 5.

Having reference now to the drawings, FIGS. 1 and 2 illustrate a load securement system generally designated as 10 for securing a load such as an automotive vehicle to a transporting vehicle such as a railroad car. The system 10 includes a tiedown winch 12 with which is associated a chain 14 adapted to be connected to a load. The winch 12 includes a chain attachment structure constructed in accordance with the principles of the present invention and generally designated as 16 (FIGS. 4–6). The chain attachment structure 16 serves releasably to interconnect the chain 14 with a tiedown drum 18 of the winch 12.

While the chain attachment structure of the present invention is illustrated and described herein in association with the tiedown winch 12, it should be understood that the present invention may be applied to the securement of load bearing chains in other types of mechanisms. For example, the chain attachment structure 16 may readily be adapted by one skilled in the art to winches and hoists of many types.

Certain features of the tiedown winch 12 are the subject of a copending application Ser. No. 760,928 of William L. Grube and Allen D. Siblik, and of a copending application Ser. No. 760,870 of Richard Edgar Hague, both of which applications are filed on the same day as the present application. The tiedown winch 12 is described in the present application to the extent that will be helpful to an understanding of the present invention. Both of said copending applications are incorporated herein by reference and may be consulted for a more detailed description of the construction and operation of the winch 12.

The chain attachment structure 16 of the present invention is best illustrated in FIGS. 4–6 of the drawings. The tiedown drum 18 includes a central portion 20 having a periphery of a generally circular cross section upon which the chain 14 is wound by rotation of the drum 18. The chain 14 includes an end link 22 releasably fixed to the portion 20 of the drum 18 by the structure 16.

More specifically, a recess 24 extends inwardly from the periphery of the drum portion 20. In the illustrated arrangement, recess 24 extends across the entire extent of the drum in a generally radial or cordal direction. However, it is not necessary to the practice of the present invention that the recess 24 traverse the full width of the drum. As best seen in FIG. 5, the recess 24 is generally rectangular in cross section and includes interfacing walls 26 and 28 defining opposed sides of the recess 24.

The intersection of the recess 24 and the periphery of the drum portion 20 comprises a mouth or end 30 of the recess whereat the chain 14 is attached. Adjacent this mouth 30 there is provided a lug 32 formed integrally with the body of the drum 18 of a single unitary material such as a metal casting or the like. The lug extends outwardly from one of the interfacing recess walls 26 toward the opposed wall 28, and includes an outermost end 34 spaced from the wall 28. Between the end 34 of the lug 32 and the wall 28 there is defined a path 36 along which the chain link 22 may be inserted into the recess 24. Preferably the space between the end 34 of the lug 32 and wall 28 is smaller than the side-to-side width of the link 22 and larger than the thickness of the link. In this manner the path 36 orients the link upon insertion in a plane generally parallel to the axis of the tiedown drum 18.

In FIG. 6 it can be seen that the lug 32 is shaped so as to be received within link 22 adjacent its innermost crown 38. Consequently, the link 22 can be inserted along path 36 into recess 24 and can be placed over the lug 32 in the attached condition illustrated in the drawings.

In order to prevent withdrawal of the chain 14 from the drum 18, a keeper pin 40 serves to block the path 36. Drum 18 is provided with a passage 42 extending through the drum and intersecting the recess 24 along the path 36. In the illustrated arrangement, the passage 42 extends in a direction parallel with the axis of rotation of the drum. The pin 40 can be inserted into the passage 42 from the top of the drum 18, and is thereafter held in place simply by gravity because the bottom of the drum 18 is blocked. If desired, the pin could be held by a friction fit or by any other retaining mechanism.

Once the link 22 has been placed over the lug 32 and the keeper pin 40 installed, the link cannot be removed from the lug 32 along the path 36. Consequently, the chain is reliably and securely attached to the drum 36. Moreover, forces applied by the chain to the drum are applied directly to the lug 32 and not to the keeper pin. Even were the chain to be fully unwound and a chain load applied in a radial direction from the drum periphery, nevertheless the chain force would be applied to the integral and sturdy lug rather than to the keeper pin.

Lug 32 is of a size and configuration to fit with some clearance yet relatively snugly within the chain link 22 and between its sides 44 and 46. As a result, the link 22 is maintained substantially parallel with the opposed walls 26 and 28 and thus substantially parallel with the axis of rotation of the drum 18. The lug 32 is positioned so that the outermost crown 47 of the link 22 projects above or radially outwardly from the periphery of the drum portion 20. As a result, a second link 48 of the chain is retained in a desired position upon the chain drum with one of its side walls 50 lying snugly against the drum surface (FIG. 4).

In order to support the chain 14 on the drum and to guide the chain as it is wound upon the drum, portion 20 of the drum is provided with a peripheral groove 52 for receiving a side of the second chain link 48 and of subsequent alternate links. In order to accommodate the second link 48 in combination with the lug 32, the groove 52 is provided with a beveled or slightly recessed portion 54 (FIG. 4) adjacent the mouth 30 of the recess 24. Portion 54 snugly receives the side 50 of the link 48 as the chain is initially wound. A third link 56 and subsequent alternate links are able to lie flat over the drum portion 20 because the groove 52 is wider than the link thickness and is narrower than the side-to-side link width.

Advantages of the chain attachment structure 16 of the present invention may be appreciated from consideration of its operation in association with the load securement system 10 and tiedown winch 12. As best illustrated in FIGS. 1–3, the winch 12 includes a housing 58 provided with lugs 60 permitting the housing to slide along a supporting channel track 62 which may be attached, for example, to the deck of a transporting vehicle such as a railroad car. The housing 58 includes a cover 64 attached by a hinge 66 so that the cover may be raised for access to a central chamber 68 wherein the tiedown drum 18 is supported. A locking mechanism 70 serves to lock the cover 64 in its illustrated closed position, and to lock the winch housing 58 at a selected position along the channel track 62.

The tiedown drum 18 includes reduced diameter portions 71 and 72 received in openings 73 and 74 in the housing 58 and cover 64. As a result, the drum 18 may be rotated by the use of a suitable tool (not shown) received in a drive socket 76 formed in the top of the drum 18. The uppermost portion of the drum is a ratchet gear 78 cooperating with a pawl lever 80 to prevent reverse rotation of the drum and to maintain the chain 14 in a taut condition.

In the illustrated arrangement, the chain 14 extends from the winch 12 to a secured load (not shown) through an idler device 82. The idler device is useful for providing both a desired angle of the chain 14 from the channel track 62 to the load and for permitting the use of a chain of desired length so that the winch 12 may be spaced from the load. The idler device 82 includes a housing 84 with lugs 86 permitting the idler device to slide along the channel track 62 to a selected position where it is held by a locking mechanism 88. Chain 14 slidably extends through an end opening in the housing 84 and out of the housing through a top opening 90. If desired, the winch 12 can be used to secure loads without the agency of the idler device 82.

In the use of the winch 12 and chain attachment structure 16, a load such as an automotive vehicle is positioned upon the deck of a transporting vehicle such as a railroad car. The winch 12 is then moved along the channel track 62 to a selected location adjacent the load, and a chain 14 is interconnected between the load and the winch 12, with an idler device 82 being used if desired.

Connection of the chain 14 to the winch 12 is facilitated by the arrangement of the present invention. The cover 64 is opened and the drum can be removed from the chamber 68. The end link 22 of the chain is simply inserted over the lug 32. When the drum is replaced within the chamber 68 and the keeper pin 40 inserted, the chain is securely interconnected with the winch 12. No wrenches or other tools are required to accomplish this attachment operation.

After attachment of the chain, the winch 12 may be located along the channel track 62 in a final position wherein the chain includes a minimal amount of slack. The locking mechanism 70 secures the winch 12 in the desired position, and the drum 18 is rotated in order to wind the chain 14 upon the drum portion 20 in order to provide the desired chain tension. During this chain wrapping operation, the chain is guided and properly positioned upon the drum by the configuration of the lug 32 and the groove 52.

In order to provide a compact arrangement and to minimize the obstruction of the railroad car deck by the winch 20, it is desirable to effect securement of the load without multiple wraps of the chain 14 upon the drum 18. Moreover, in some instances, little or no wrapping of the chain 14 on the drum may occur. For example, if more than one winch 12 are used to secure a single load, one winch may be used simply as an anchoring device with no winding of the chain upon the drum. Consequently, it is extremely important that substantial chain loads can be accommodated without damaging the chain attachment structure and without any possibility of the chain becoming detached from the drum.

The chain attachment structure 16 of the present invention accomplishes these ends because chain loads are applied directly to the lug 32 and thus to an integral and sturdy part of the tiedown drum 18. The keeper pin 40 merely blocks the link insertion path 36 and does not support chain loads directly. Consequently, the keeper pin 40 does not need to be strong enough to withstand breaking or bending due to chain loads. Even after the application of large loads the pin 40 is not deformed and can easily be withdrawn from the passage 42 when detachment of the chain is desired.

Although the invention has been described with reference to details of the illustrated embodiment, it should be understood that such details are not intended to limit the invention as defined in the following claims.

What is claimed and desired to be secured by Letters Patent of the United States is:

1. A releasable chain attachment structure for a load-bearing chain winding device, said structure including:

a unitary, one-piece drum member having a periphery with a generally circular cross section;

a recess extending inwardly from the periphery of the drum member defined between a spaced-apart interfacing pair of internal walls;

a lug integral with said drum member extending part way from a first said internal wall toward the second internal wall;

the distance between said lug and the second internal wall being larger than the chain link thickness so that a chain link can be inserted along a path in said recess and into registration with said lug;

said lug being no larger than the interior of said link so that said link can be placed over said lug;

and a keeper movable into said recess to obstruct said chain insertion path for retaining said link on said lug;

the distance between the outermost end of said lug and the second internal wall being smaller than the side-to-side chain link width.

2. The structure of claim 1, said lug being located adjacent the mouth of said recess.

3. The structure of claim 2, further comprising a groove circumscribing said periphery, said mouth being in registration with said groove.

4. The structure of claim 1, said interfacing walls being generally parallel with a plane drawn through the axis of said drum.

5. A releasable chain attachment structure for a load-bearing chain winding device, said structure including:

a unitary, one-piece drum member having a periphery with a generally circular cross section;

a recess extending diametrically inwardly from the periphery of the drum member defined between a spaced-apart interfacing pair of internal walls;

a lug integral with said drum member extending part way from a first said internal wall toward the second internal wall;

the distance between the outermost end of said lug and the second internal wall being larger than the chain link thickness so that a chain link can be inserted along a generally diametric path of said drum member in said recess and into registration with said lug;

said lug being no larger than the interior of said link so that said link can be placed over said lug;

and a keeper movable into said recess to obstruct said chain insertion path for retaining said link on said lug.

6. The structure of claim 5, said lug being located adjacent the mouth of said recess.

7. The structure of claim 6, further comprising a groove circumscribing said periphery, said mouth being in registration with said groove.

8. The structure of claim 5, said interfacing walls being generally parallel with a plane drawn through the axis of said drum.

* * * * *